US006079081A

United States Patent [19]

Padiak et al.

[11] Patent Number: 6,079,081

[45] Date of Patent: Jun. 27, 2000

[54] DOOR MOUNT ASSEMBLY FOR STORAGE RACK

[75] Inventors: Scott Padiak, Winnetka; Thomas M. Conway, Chicago, both of Ill.

[73] Assignee: Cormark, Inc., Elk Grove Village, Ill.

[21] Appl. No.: 09/195,762

[22] Filed: Nov. 18, 1998

[51] Int. Cl.[7] ..... G09F 3/18

[52] U.S. Cl. ..... 16/321; 16/334; 16/336; 49/394

[58] Field of Search ..... 16/321, 320, 325, 16/268, 334–336, 319, 324; 292/80, 87, DIG. 38; 49/394; 211/192

[56] References Cited

U.S. PATENT DOCUMENTS

| | | | |
|---|---|---|---|
| Re. 30,734 | 9/1981 | Eckert . | |
| 268,616 | 12/1882 | Brown . | |
| 760,299 | 5/1904 | Belding . | |
| 1,025,349 | 5/1912 | Weisberger . | |
| 1,111,458 | 9/1914 | Hight . | |
| 1,220,758 | 3/1917 | Lamphiear . | |
| 1,559,010 | 10/1925 | Schwieger . | |
| 1,627,350 | 5/1927 | Steinman . | |
| 1,793,563 | 2/1931 | Schwartz . | |
| 1,866,723 | 7/1932 | Powers . | |
| 2,646,241 | 7/1953 | McLean . | |
| 2,651,805 | 9/1953 | Laible | 16/321 |
| 2,787,433 | 4/1957 | Slavsky et al. . | |
| 2,845,729 | 8/1958 | Baumgart . | |
| 3,082,989 | 3/1963 | Bower . | |
| 3,102,351 | 9/1963 | Howell . | |
| 3,203,031 | 8/1965 | Youngdale et al. | 16/321 |
| 3,529,798 | 9/1970 | Williams et al. . | |
| 3,669,392 | 6/1972 | Saunders . | |
| 3,889,914 | 6/1975 | Torme . | |
| 3,969,838 | 7/1976 | Moore . | |
| 4,344,244 | 8/1982 | Tyke . | |
| 4,369,948 | 1/1983 | Krauss et al. . | |
| 4,496,126 | 1/1985 | Melton et al. . | |
| 4,531,311 | 7/1985 | Howard et al. . | |
| 4,574,507 | 3/1986 | Elliott . | |
| 4,593,486 | 6/1986 | Visocky et al. . | |
| 4,616,799 | 10/1986 | Rebentisch . | |
| 4,709,891 | 12/1987 | Barnett . | |
| 4,729,183 | 3/1988 | Tarter et al. . | |
| 4,791,739 | 12/1988 | Hetzer . | |
| 4,798,013 | 1/1989 | Sainato . | |
| 4,805,331 | 2/1989 | Boggess et al. . | |
| 4,821,437 | 4/1989 | Abramson et al. . | |
| 4,866,867 | 9/1989 | Clark . | |
| 4,869,376 | 9/1989 | Valiulis et al. . | |
| 4,881,707 | 11/1989 | Garfinkle . | |
| 4,884,351 | 12/1989 | Abramson . | |

(List continued on next page.)

FOREIGN PATENT DOCUMENTS

| | | | |
|---|---|---|---|
| 2067706 | 7/1981 | United Kingdom | 211/192 |

*Primary Examiner*—Anthony Knight
*Assistant Examiner*—Mark Williams
*Attorney, Agent, or Firm*—Welsh & Katz, Ltd.

[57] ABSTRACT

A mount assembly for a door panel for a storage rack is adapted for use with a rack having a post having a side face and a front face, and defining openings in the post front face. The mount includes a stationary hinge plate mounted to the post and a door panel support pivotally mounted to the hinge plate by a pivot pin. The hinge plate has a body for positioning adjacent and in contact with the side face of the post. The plate includes a locking tab extending from the body that is configured for insertion into the opening in the front face of the post. The hinge plate includes a receiving element in spaced relation to a pin receiving opening. The door panel support includes an elongated arm for mounting the door panel thereto and a base portion. The base portion defines a pin receiving opening that aligns with the hinge plate pin receiving opening for receipt of the pivot pin for pivotally mounting the door panel support to the hinge plate. The door panel support further includes a latch element adapted for engagement with the hinge plate receiving element for releasably locking the support to the hinge plate in a closed position and adapted to disengage from the receiving element for pivoting the support to an open position.

15 Claims, 4 Drawing Sheets

U.S. PATENT DOCUMENTS

| | | | |
|---|---|---|---|
| 4,909,464 | 3/1990 | Levine et al. . | |
| 4,957,256 | 9/1990 | Boeding . | |
| 5,106,046 | 4/1992 | Rowles et al. . | |
| 5,111,606 | 5/1992 | Reynolds . | |
| 5,189,822 | 3/1993 | Schmanski et al. . | |
| 5,230,174 | 7/1993 | Reed . | |
| 5,233,726 | 8/1993 | Cress | 16/336 |
| 5,237,767 | 8/1993 | Kringel et al. . | |
| 5,383,793 | 1/1995 | Hsu et al. . | |
| 5,408,775 | 4/1995 | Abramson et al. . | |
| 5,472,289 | 12/1995 | Kringel et al. . | |
| 5,769,369 | 6/1998 | Meinel . | |
| 5,784,758 | 7/1998 | Carrick | 16/321 |
| 5,937,481 | 8/1999 | Faringosi | 16/334 |

230
214
250
260
236
228
238
234
244
266
232

252
268
270
214
234
262
228
236
236
230
232
240

DOOR MOUNT ASSEMBLY FOR STORAGE RACK

FIELD OF THE INVENTION

This invention pertains to a door mount assembly for mounting a door to a storage rack. More particularly, the invention pertains to a readily installed one-piece mount arm and hinge assembly for mounting doors to a storage rack.

BACKGROUND OF THE INVENTION

A wide variety of storage system, such as shelves, racks and the like, are used in both the retail and wholesale trades for storing and displaying items for sale. One common type of shelf system that is used, particularly in home improvement centers, and "warehouse-club" types of establishments, is commonly referred to as a pallet rack. Other types of heavy-duty shelving systems are also known and widely used.

Such storage systems typically include vertical risers or posts for supporting one or more shelves. The shelves span the area between the vertical posts. Although these shelves are primarily used to store consumer-accessible items, they are also often used to store merchandise stock. To this end, doors or covers can be mounted in front of these stock-storage shelves in order to deter consumer access or to prevent what might otherwise be an unsightly or unaesthetically appealing storage arrangement of merchandise.

Known door mount systems suffer from a number of drawbacks. First, such systems are installation intensive. That is, these known system include numerous parts, and thus require considerable labor to install. In addition, such systems often include a large number of parts, and in particular small parts, such as hinges, nuts, bolts and the like, which can become easily lost or misplaced. As such, installation time and labor can be even greater than necessary.

Moreover, these door systems can be bulky and difficult to install, particularly if the doors are large. These large, bulky door panels can be difficult to install and align when attempting to fit hinge pins or hinge posts into small openings, with the weight, and center of gravity of the doors making it difficult and unwieldy to maintain the doors steady.

Accordingly, there exists a need for a door and hinge assembly for mounting doors to storage racks. Desirably, such an assembly provides an essentially tool-less installation and permits readily installing covering doors to provide an aesthetically appealing visual appearance to such storage shelves.

SUMMARY OF THE INVENTION

A mount assembly for a door panel is used with a storage rack having a post having a side face and a front face, and defining openings in the front face. The mount comprising a stationary hinge plate mountable to the post and a door panel support pivotally mounted to the hinge plate by a pivot pin.

The assembly permits ready installation of storage system doors with minimal tools. To this end, the hinge plate has a body for positioning adjacent and in contact with the side face of the post. The plate includes at least one and preferably two locking tabs that extend from the body and are configured for insertion into respective openings in the front face of the post. The plate can be further secured to the post by fasteners that are inserted through the plate after the tags are positioned in the post openings. The hinge plate includes a receiving element and further defines a pin receiving opening therein in spaced relation from one another.

The door panel support includes an elongated arm for mounting the door panel thereto and a base portion that is preferably integral with the arm. The base portion defines a pin receiving opening that aligns with the hinge plate pin receiving opening for receipt of the pivot pin. The door panel support further includes a latch element that is adapted for engaging the hinge plate receiving element to releasably lock the support to the hinge plate in a closed position and to disengage from the receiving element for pivoting the support to an open position.

Advantageously, the present assembly facilitates installation of doors to the storage rack system. To this end, because the hinge plate initially mounts to the post by simple insertion of the locking tabs into the post openings rather than by fasteners, the plate can be readily set onto the post. Unlike known door mount system, this shifts the weight and the bulk of the door and support during installation from the installer to the storage system posts, thus reducing the labor necessary to install the doors.

In a preferred arrangement, the hinge plate includes an angled leg that extends transversely from the body and includes two locking tabs that extend transversely from the angled leg for securing the hinge plate to the post. Most preferably, the locking tabs include barbs at about an end thereof.

In a most preferred embodiment, the hinge plate includes an opening therein for receipt of the receiving element, and the receiving element assembles to the plate without the use of tools. In a current configuration, the receiving element includes a body that inserts into the hinge plate opening and further includes securing members for securing the receiving element to the hinge plate. The securing members can include a lip for engagement with an edge of the opening and a resilient snap for engagement with an opposing edge of the opening.

In one contemplated embodiment, the receiving element includes a resilient leg connected to the base by an arcuate or curved connecting portion. Preferably, the connecting portion is configured complementary to the support base latch element for releasably securing the latch element therein.

In an alternate embodiment, the receiving element includes an angled body having a head portion that is transversely oriented relative to the hinge plate body, and the head portion is enlarged to secure the latch element therein. The receiving element can be secured to the hinge plate by a simple mechanical fastener, such as nut and bolt sets.

In still another alternate configuration, the assembly can be formed as molded parts, and the base latch element can have a generally V-shaped body connected to the base at a top of one of the legs of the "V". The top of the other leg of the "V" is configured for engaging the receiving element.

These and other features and advantages of the present invention will be apparent from the following detailed description, the accompanying drawings, and the appended claims.

BRIEF DESCRIPTIONS THE DRAWINGS

DETAILED DESCRIPTION OF THE PREFERRED EMBODIMENTS

Figure 1:
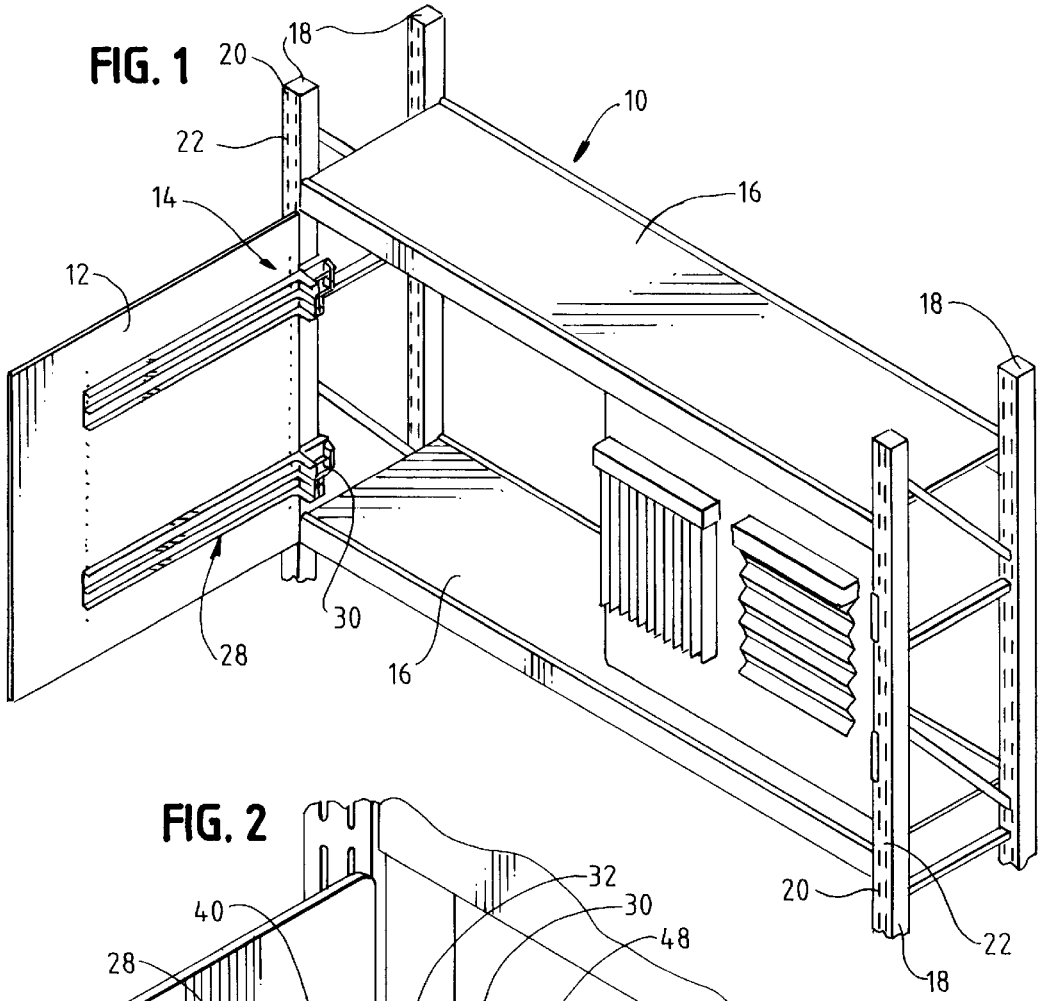
FIG. 1 is a perspective view of a storage shelf system having mounted thereto a door panel that is mounted using a door mount assembly in accordance with the principles of the present invention.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Figure 3:
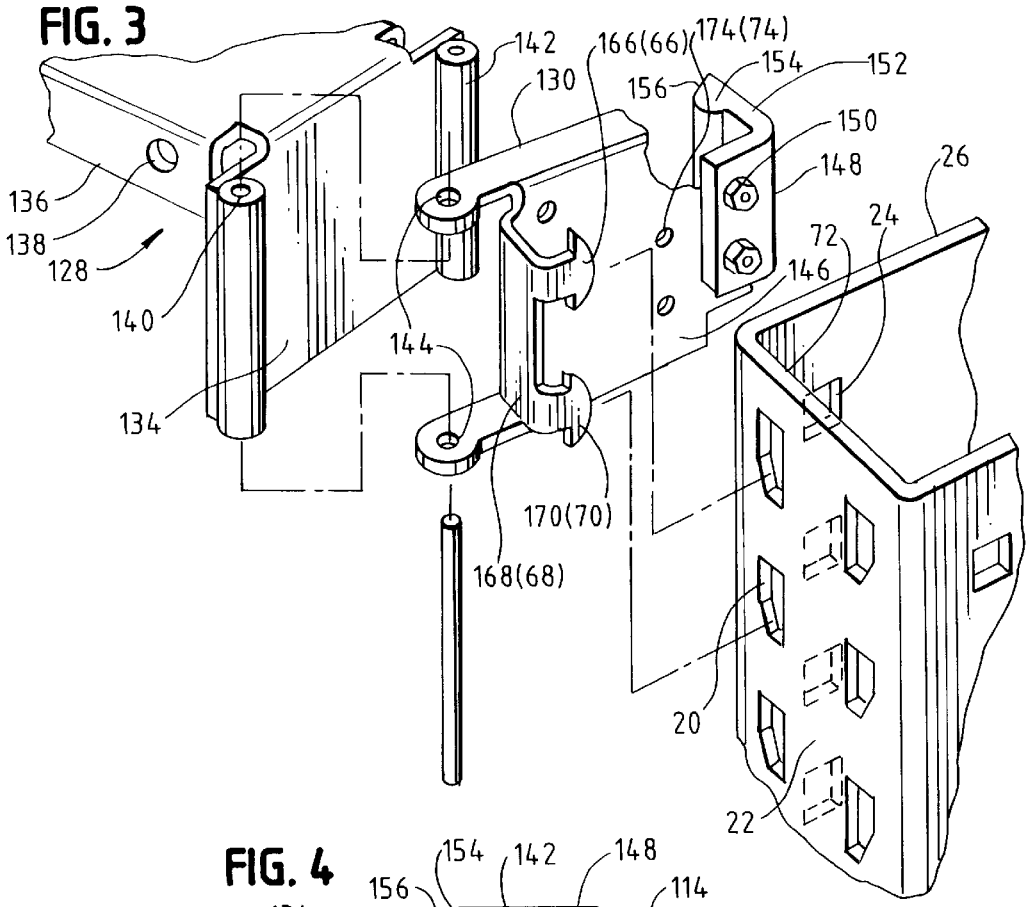
FIG. 3 is an exploded view of an alternate embodiment of the door mount assembly, illustrating the door mount connected to a vertical riser post of the exemplary storage shelf system.

Referring now to the figures and in particular to FIG. 1, there is shown a storage shelf arrangement 10 having a door 12 mounted thereto by one embodiment of a hinge or door mount assembly 14. The storage shelf system 10 includes one or more horizontally oriented shelves 16 on which items can be stored. These shelves 16 are supported by a plurality of vertical posts or uprights 18 that are in spaced parallel relation to one another. A single, stand-alone shelf system or assembly typically includes four posts. Those skilled in the art will recognize that such shelf systems can be stand-alone or can be mounted adjacent to one another with a subsequent pair of posts supporting subsequent, adjacent shelves. In a typical arrangement, the posts 18 include openings or slots 20 in a front face 22 thereof, as illustrated in FIG. 3, and further openings 24 along a side face 26 of the post 18.

The door mount assembly 14 includes a support portion 28 that is pivotally mounted to a stationary hinge plate 30 by a pivot pin 32. The support portion 28 includes a base 34 and an elongated arm 36 to which the door panel 12 is mounted. The arm 36 includes openings 38 therein through which fasteners, such as bolts (not shown) can be inserted to secure the door panel 12 to the arm 36. The base 34 includes a pin receiving opening 40 and at least one latch element 42 spaced from the pin receiving opening 40. The hinge plate 30 also includes at least one pin receiving opening 44 that is complementary to and aligns with the base pin receiving opening 40. The pivot pin 32 inserts through the openings 40, 44 to provide pivotal movement of the support portion 28 relative to the hinge plate 30.

The hinge plate 30 includes a main body 46 that is positioned on the post 18, adjacent and contacting the side face 26 of the post 18. The plate 30 further includes at least one receiving element 48 that is configured to engage the base latch element 42. The latch element 42 and receiving element 48 engage one another to secure the arm 36 to the hinge plate 30 in the closed position.

Figure 2:
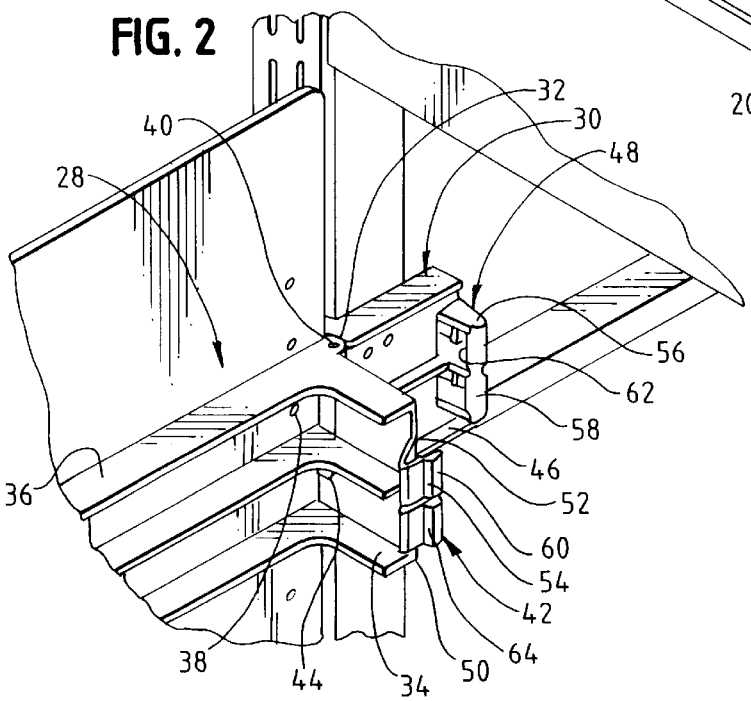
FIG. 2 is a partial, enlarged view of the door mount assembly of FIG. 1.

In one embodiment, as illustrated in FIGS. 1–2, the support 28 can be formed as a molded element and the base 34 can extend transversely from the arm 36. The base latch 42 can be formed as a resilient member extending from an end 50 of the base 34 in opposing relation to, and spaced from the pin receiving opening 40. In a preferred arrangement, two latch elements 42 having generally V-shaped bodies extend from the base 34, and are each connected to the base 34 at the "top" 52 of one of the legs of the V-shaped body to provide flexibility to the latch element 42. The top 54 of the other leg of the "V" is enlarged and engages the hinge plate receiving element 48 in a snap-lock manner to secure the latch elements 42 to the receiving elements 48.

The hinge plate receiving element 48 includes an extension portion 56 and a shoulder 58 that is adapted to engage the latch element 42. As the latch element 42 is urged over the shoulder 58, it flexes inward until the enlarged end 60 passes over the shoulder 58, at which point the latch 42 and receiving element 48 are fully engaged with one another. This corresponds to the closed position of the door 12. The shoulder 58 can be ramped or inclined, as indicated at 62, to facilitate engaging the latch 42 with the receiving element 48 when closing the door 12. The enlarged "V" leg end 60 can also be ramped or inclined, as indicated at 64, so that to open the door 12 (or disengage the latch 42 from the receiving element 48) it is necessary only to urge the door 12 open, which disengages the latch 42 from the receiving element 48.

The hinge plate 30 secures to the post 18 by one or more, and preferably two hooked, locking projecting tabs or fingers 66 that extend from an angled leg portion 68 of the plate 30. Preferably, the tabs 66 include barbs, indicated at 70, that are formed at about the ends thereof. The leg portion 68 and hooked tabs 66 of this embodiment are similar to those of the mount assembly embodiment 114 illustrated in FIGS. 3–4. The tabs 66 insert into the openings 20 in the front face 22 of the post 18.

The tabs 66 insert into the openings 20 in the front face 22 of the post 18 and lock into the post 18 by downward urging of the tabs 66 so that the barbs 70 engage an inner surface 72 of the post 18. As will be apparent from the figures, the body 46 of the hinge plate 30 rests against the side face 26 of the post 18 and the tabs 66 are angled and insert through the front face openings 20, into the post 18. Openings 74 formed in the hinge plate 30 are configured to receive fasteners, such as bolts 76, to enhance securely mounting the plate 30 to the post 18.

Figure 4:
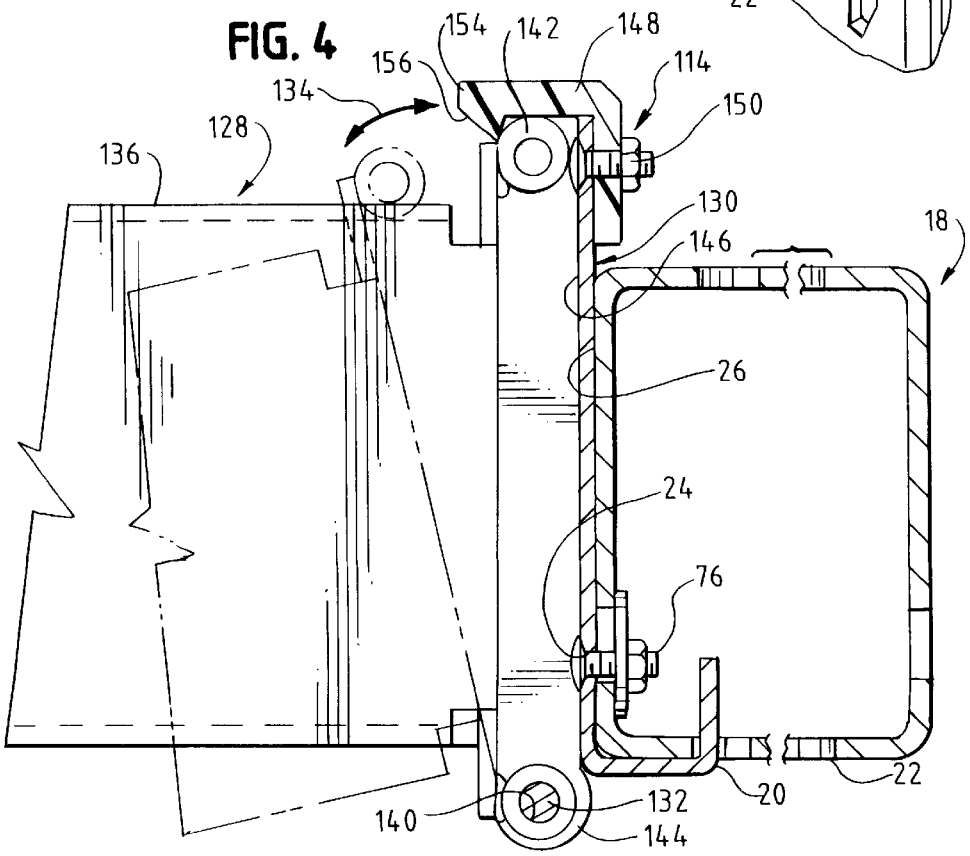
FIG. 4 is a partial, cross-sectional top view of the mount assembly of FIG. 3, illustrating the assembly in the locked position in solid lines, and pivoted into the open position in broken or shadow lines.
Figure 5:
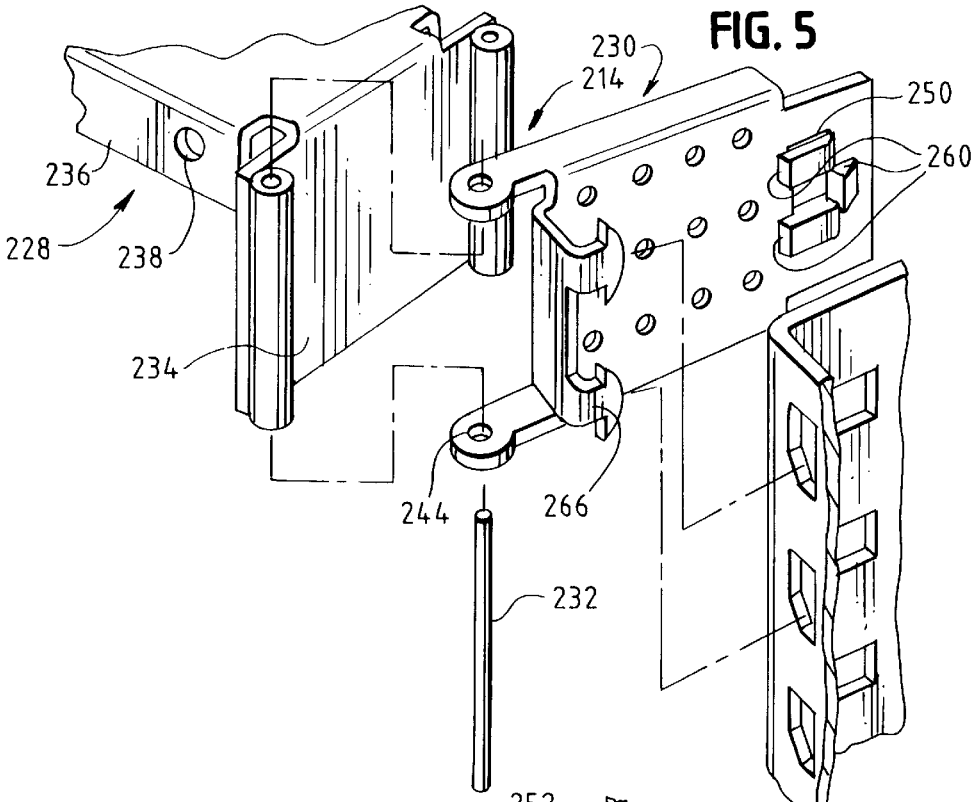
FIG. 5 is yet another alternate embodiment of the mount assembly illustrated in an exploded view similar to FIG. 3.
Figure 6:
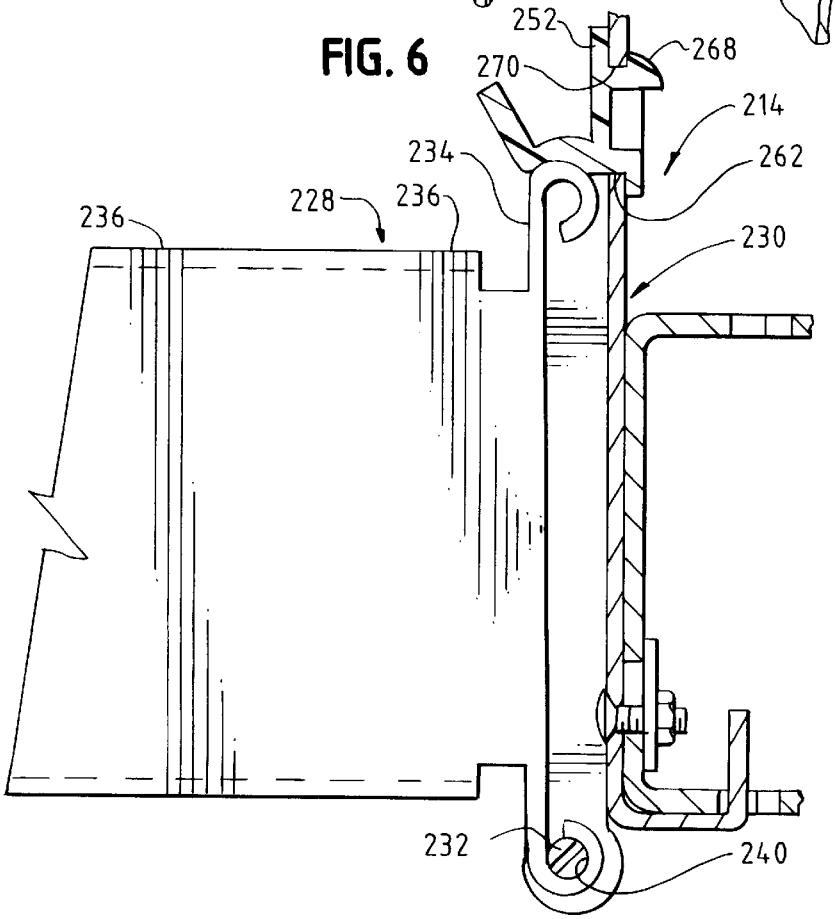
FIG. 6 is a top, partial cross-sectional view of the mount assembly of FIG. 5.

An alternate embodiment of the mount 114 is illustrated in FIGS. 3 and 4. In this embodiment, the assembly 114 is formed from metal, such as steel. The support 128, that is the arm 136 and base 134, are preferably formed from a single piece of material using methods known by those skilled in the art. As seen in FIGS. 3–4, the pin receiving opening 140 and the latch element 142 can be separately formed elements secured to the base 134 (such as by welding), or can be formed from the base 134 as rolled and formed portions of the material (which rolled and formed configurations are illustrated in FIGS. 5 and 6 at 240 and 242, respectively, and the methods of forming such rolled and formed portions will be readily recognized by those skilled in the art). The rolled and formed configuration 240, 242 reduces the number of material connections or joints necessary for fabrication, thus reducing the labor necessary to manufacture the support portion.

Referring again to FIGS. 3–4, the hinge plate 130 of this embodiment includes a discretely formed, separate receiving element 148 that is fastened to the plate 130 by fasteners, such as bolt and nut sets 150. In a contemplated configuration, the receiving element 148 is formed from a resilient material, that can be resinous, polymeric and the like. The receiving element 148 includes an angled body 152 having an enlarged head portion 154. The head 154 can be partially rounded or can have inclined surfaces, as indicated at 156, to facilitate engaging and disengaging the latch 142 and receiving element 148 with one another.

Figure 7:
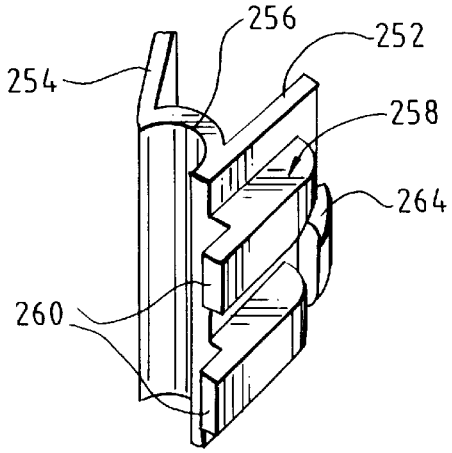
FIG. 7 is a perspective view of an insert clip that is used with the mount assembly of FIG. 5 for securing the mount in the closed or locked position.

Still another embodiment of the mount 214 is illustrated in FIGS. 5–7. In this preferred embodiment, the support 228 portion including the arm 236 and base 234 are formed similar to that of the embodiment 114 shown in FIGS. 3–4. This embodiment 214 is illustrated with the pin receiving opening 240 and the latch 242 formed as rolled portions of the support 228 material.

The hinge plate 230 includes a separate fastener-less receiving element 248 that secures or locks into an opening 250 in the plate 230. The receiving element 248, which is best seen in FIG. 7, includes a base 252 that rests against the hinge plate 230 and a leg 254 that is connected to the base 252 by an arcuate connecting portion 256. The base 252, arcuate connecting portion 256 and leg 254 are contiguous, and form the receiving element 248. As seen in FIG. 6, the connecting portion 256 is preferably formed complementary to the latch element 242 to provide a secure fit with one another.

The fastener-less arrangement by which the receiving element 248 secures to the hinge plate 230 includes securing members 258 such as the exemplary lip 260 that extends from the base 252 over an edge 262 of the plate opening 250 and the illustrated snap element 264 that extends from the base 252 over an opposing edge 270 of the plate opening 250 to secure the receiving element 248 in place. The snap 264 can include a rounded or inclined surface, as indicated at 268 to facilitate insertion through the opening 250. The receiving element 248, like that of the embodiment 114 illustrated in FIGS. 3 and 4, is preferably formed from a resinous or polymeric material to provide resiliency and strength.

Figure 8:
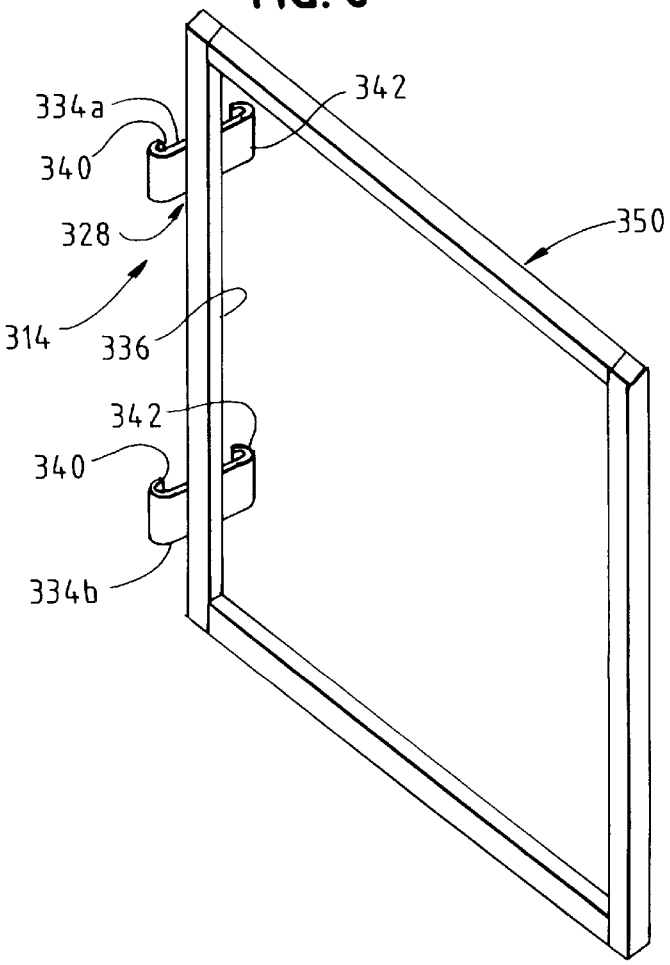
FIG. 8 is a perspective view of another configuration in which the assembly includes a vertical support arm that has a pair of base portions mounted thereto, and which arm is formed as part of a frame for supporting the door panel.

FIG. 8 illustrates the support portion 328, namely the base 334 and arm 336 of still another embodiment 314 of the present assembly. In this embodiment, the support 328 has a vertical arm 336 and the base 334 is mounted to the arm 336 by, for example, welding, mechanical fasteners, such as bolts and the like. The connection of the base 334 to the arm 336 can be carried out as part of the manufacturing process, rather than as part of the installation, to facilitate reducing the installation time and labor. In this embodiment, the base portion 334 of the support 328, that is the pin receiving opening 340 and the latch element 342 are configured and function similar to that shown in the embodiment 114, 214 illustrated in FIGS. 3–4 and 5–7, respectively. As is apparent from the figures, in this embodiment, the arm 328 is essentially formed as part of a frame 350 for supporting the door panel 12 and can include two or more base portions 334*a*, 334*b* mounted thereto.

Use of the present assembly 14, 114, 214, 314 is straightforward.

With the doors 12 installed using the mount, the doors 12 are secured closed by simply closing the doors 12 and urging each latch 42, 142, 242, 342 into engagement with its respective receiving element 48, 148, 248, 348.

Engagement of the latch 42, 142, 242, 342 and receiving element 48, 148, 248, 348 maintains a door 12 in the closed position. To open the door 12, it is necessary only to urge the door 12 open, which disengages the latch 42, 142, 242, 342 from its respective receiving element 48, 148, 248, 348.

Those skilled in the art will recognize the advantages of the present door mount assembly 14, 114, 214, 314 over known assemblies. First, the present assembly permits ready installation of the storage system doors 12 with minimal tools. To this end, because the hinge plate 30, 130, 230, 330 initially mounts to the post by simple insertion of the locking tabs 66, 166, 266, 366 into the post front face openings 20 rather than by fasteners, a plate 30, 130, 230, 330 can be readily set onto a post 18. The fasteners 76 can then be inserted through the plate 30, 130, 230, 330 and into the post 18 while the weight and the bulk of the door 12 and support 28, 128, 228, 328 rests on the post 18, rather than being carried by the installer. This arrangement considerably reduces the labor necessary to install the doors 12. It will be apparent from the figures and the above description that the doors 12 can be mounted to the storage system 10 by a single installer with little or no assistance. The essentially tool-less installation of the present mount assembly 14, 114, 214, 314 also reduces installation time and complexity that is often associated with known door mount arrangements.

From the foregoing, it will be observed that numerous modifications and variations can be effectuated without departing from the true spirit and scope of the normal concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A mount assembly for a door panel for a storage rack, the rack having a post having a side face and a front face, and defining openings in the front face, the mount comprising:

a stationary hinge plate mountable to the post and a door panel support pivotally mounted to the hinge plate by a pivot pin, the hinge plate having a body for positioning adjacent and in contact with the side face of the post and including a locking tab extending from the body and configured for insertion into the opening in the front face of the post, the hinge plate including an opening for receipt of a receiving element, the receiving element having a body for receipt in the hinge plate opening and including securing members for securing the receiving element to the hinge plate, the securing members including a lip for engagement with an edge of the opening and a resilient snap for engagement with an opposing edge of the opening, the hinge plate further defining a pin receiving opening therein, and the door panel support including an elongated arm for mounting the door panel thereto and a base portion, the base portion defining a pin receiving opening that aligns with the hinge plate pin receiving opening for receipt of the pivot pin for pivotally mounting the door panel support to the hinge plate, the door panel support further including a latch element adapted for engagement with the hinge plate receiving element for releasably locking the support to the hinge plate in a closed position and adapted to disengage from the receiving element for pivoting the support to an open position.

2. The mount assembly in accordance with claim 1 wherein the door panel support elongated arm and base are formed integral with one another.

3. The mount assembly in accordance with claim 1 wherein the hinge plate includes an angled leg extending transversely from the body and wherein two locking tabs extend transversely from the angled leg for securing the hinge plate to the post.

4. The mount assembly in accordance with claim 3 wherein the locking tabs include barbs at about an end thereof.

5. The mount assembly in accordance with claim 1 wherein the hinge plate body includes openings therein.

6. The mount assembly in accordance with claim 1 wherein the receiving element includes a base portion and a resilient leg connected thereto by a connecting portion, and wherein the connecting portion is configured complementary to the support base latch element for releasably securing the latch element therein.

7. The mount assembly in accordance with claim 1 wherein the receiving element includes an angled body having a head portion transversely oriented relative to the hinge plate body.

8. The mount assembly in accordance with claim 7 wherein the head portion is enlarged to secure the latch element therein.

9. The mount assembly in accordance with claim 7 wherein the receiving element is secured to the hinge plate by a fastener.

10. The mount assembly in accordance with claim 1 wherein the latch element extends from the base in spaced relation to the pin receiving opening.

11. A mount assembly for a door panel for a storage rack, the rack having a post having a side face and a front face, and defining openings in the front face, the mount comprising:

a stationary hinge plate mountable to the post and a door panel support pivotally mounted to the hinge plate by a pivot pin, the hinge plate having a body for positioning adjacent and in contact with the side face of the post and including a locking tab extending from the body and configured for insertion into the opening in the front face of the post, the hinge plate including a receiving element, the hinge plate further defining a pin receiving opening therein, and the door panel support including an elongated arm for mounting the door panel thereto and a base portion, the base portion defining a pin receiving opening that aligns with the hinge plate pin receiving opening for receipt of the pivot pin for pivotally mounting the door panel support to the hinge plate, the door panel support further including a latch element adapted for engagement with the hinge plate receiving element for releasably locking the support to the hinge plate in a closed position and adapted to disengage from the receiving element for pivoting the support to an open position, wherein the base latch element has a generally V-shaped body connected to the base at a top of a leg of the body and wherein a top of the other leg of the body is configured for engaging the receiving element.

12. The mount assembly in accordance with claim 11 wherein the leg top configured for engagement with the receiving element is enlarged.

13. The mount assembly in accordance with claim 11 wherein the receiving element includes an extension and a shoulder, the shoulder being configured for engaging the latch element.

14. The mount assembly in accordance with claim 1 wherein the elongated arm is oriented vertically and includes at least one base portion mounted thereto.

15. The mount assembly in accordance with claim 14 including two base portions mounted to the elongated arm.

* * * * *